United States Patent [19]

Wheeler

[11] 4,093,974

[45] June 6, 1978

[54] FLORESCENT LIGHT FIXTURE

[76] Inventor: Kenneth A. Wheeler, 6301 Glade, #315, Woodland Hills, Calif. 91364

[21] Appl. No.: 728,783

[22] Filed: Oct. 1, 1976

[51] Int. Cl.[2] ..... H05B 33/02

[52] U.S. Cl. ..... 362/216; 339/50 C; 362/226

[58] Field of Search ..... 240/51.12, 51.11 R, 240/52.1; 339/50 C, 147 P, 167, 2 R, 2 L, 153, 154 L

[56] References Cited

U.S. PATENT DOCUMENTS 2,943,238 6/1960 Reaves ..... 240/51.12 X 3,742,208 6/1973 Mills ..... 240/51.12

*Primary Examiner*—Richard L. Moses

*Attorney, Agent, or Firm*—Lyon & Lyon

[57] ABSTRACT

A light fixture for florescent tubes designed to be mounted in incandescent light bulb sockets. This fixture is particularly adapted for replacing incandescent down-lights mounted in ceilings. A standard plug is positioned at one end of an extensible member while a transformer box and backing plate are attached at the other end of the extensible member. The extensible member includes telescoping tubes of square cross-section.

4 Claims, 2 Drawing Figures

FLORESCENT LIGHT FIXTURE

BACKGROUND OF THE INVENTION

The present invention is directed to light fixtures and particularly to a florescent light fixture capable of replacing an incandescent light in a ceiling down-light.

Incandescent lamps have long been employed as down-lights in ceilings. In modern building construction, these lights are often mounting in fixtures above a suspended ceiling such that the depending bulb has a front glass near the plane of the suspended ceiling. These bulbs are normally screwed into the fixture by means of a standardized light socket for incandescent bulbs.

Incandescent bulbs have recently come into some disfavor because of the heat generated by the bulbs and because of the energy consumption and lack of lighting efficiency when compared with florescent lighting. National standards are ever increasing with respect to the amount of heat which can be conducted to a junction box, a ceiling and other near-by components. The incandescent light generates a significant amount of heat energy which can make such standards difficult to meet, particularly in ceiling mounted light fixture applications. On the other hand, florescent lighting generates far less heat which might be conveyed to such a junction box, ceiling or the like. However, florescent fixtures normally require substantially different mounting and socket systems than are required by incandescent bulbs; and replacement of incandescent lighting by florescent lighting has generally required major revisions to the building.

The level of efficiency of incandescent bulbs, as measured by the amount of light generated per unit of input power, is much lower than that for florescent lighting. Consequently, to obtain the same lighting effect, greater amounts of energy are required for any given situation. With the increase in the cost of power, incandescent lighting has become relatively costly. Again, switching to florescent lighting can also be very expensive because of the great differences in mounting and electrical hook-ups. The cost of switching to florescent lighting has often out-weighed any benefit achieved from the more efficient system.

SUMMARY OF THE INVENTION

The present invention is directed to a lighting fixture which adapts to mountings for incandescent bulbs. However, the fixture of the present invention is for florescent lights. Thus, low cost replacement of incandescent lighting without disruptive modifications to the building or building interior can be achieved using the present invention. At the same time, the heating problems associated with incandescent lighting and the power drain associated with incandescent lighting are to a large extent obviated.

Because down-lights for ceiling mounted incandescent bulbs are not standardized as to the location of the light socket relative to the ceiling and because of the restriction of space adjacent the socket, a standardized replacement fixture for such incandescent bulbs in down-light installations has required custom modifications normally resulting in the entire replacement of the incandescent light fixture. By the present invention, an extensible member is employed which is able to accommodate a wide variety of light socket positions. At the same time, the extensible member provides advantageous placement of the light plug and permits threading of the plug into the existing socket and adjustment of the lighting fixture such that the backing plate for the florescent light will be flush with the ceiling.

Accordingly, it is an objective of the present invention to provide a florescent light fixture easily installed in a mounting for incandescent bulbs. Other and further objects and advantages will appear hereinafter.

DETAILED DESCRIPTION OF THE PREFERRED EMBODIMENT

Figure 1:
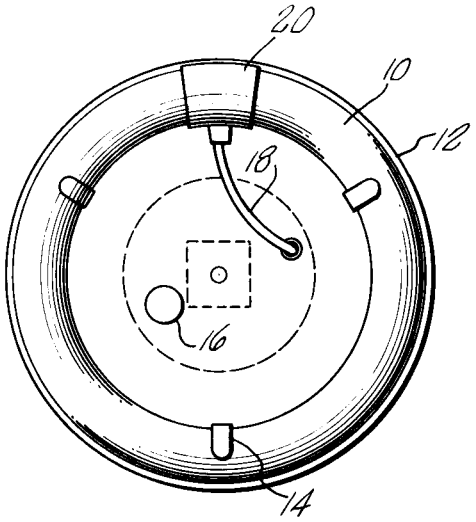
FIG. 1 is a plan view, as seen from below, of the present invention.

Turning in detail to the figures, a florescent light fixture is disclosed with a toroidal florescent tube 10 positioned on the fixture. A diffuser in any number of esthetic configurations may be positioned around the florescent tube 10. However, as the diffuser has no bearing on the present invention, it has been excluded.

The tube 10 is mounted to a backing plate 12 by means of brackets 14. Three such brackets are illustrated. The backing plate 12 is subtantially of sheet metal construction and normally has a white or reflective under-surface to ensure diffusion of a maximum amount of light. A hole extends through the backing plate 12 for receipt of a starter 16. In this way, the starter may be replaced without disassembly of the unit when it becomes defective. The coupling 18 also extends from the backing plate 12 for providing electrical power to the tube 10 at the contacts provided in the tube electrode assembly 20.

Mounted to the back side of the backing plate 12 is a transformer box 22. The transformer box 22 is conveniently attached to the backing plate 12 by fasteners 24. Located within the terminal box 22 are the electrical leads, the transformer and starter necessary for the operation of a florescent light. In the present embodiment, the transformer box 22 is substantially cylindrical with the backing plate 12 at one end and a formed top 26 at the other. This compact configuration for the transformer box 22 allows it to be positioned in a location originally occupied by an incandescent light bulb.

Rigidly fixed to the top 26 of the transformer box 22 by means of fasteners 28 is a shaft 30. The shaft 30 is constructed of a tube having a hollow, square cross-section. The shaft 30 extends from the backing plate 12 a distance which is less than the anticipated distance between the ceiling and the socket in the incandescent fixture with which the present fixture is to be associated.

Cooperating with the shaft 30 is another shaft 22 which is also of tubing having a hollow, square cross-section. The shaft 32 is smaller than the shaft 30 in order that the shaft 32 may be telescoped within the shaft 30. Some clearance is considered advantageous for ease of assembly and to prevent binding. However, the shaft 32 is preferably large enough so that it is unable to rotate to any substantial extent within the shaft 30. In this way, torque may be transmitted from the shaft 30 to the shaft 32. The combined shafts 30 and 32 thus form an extensible member which allows relative movement between the shafts in an axial direction but which rigidly constrains each shaft from rotating relative to the other shaft.

Figure 2:
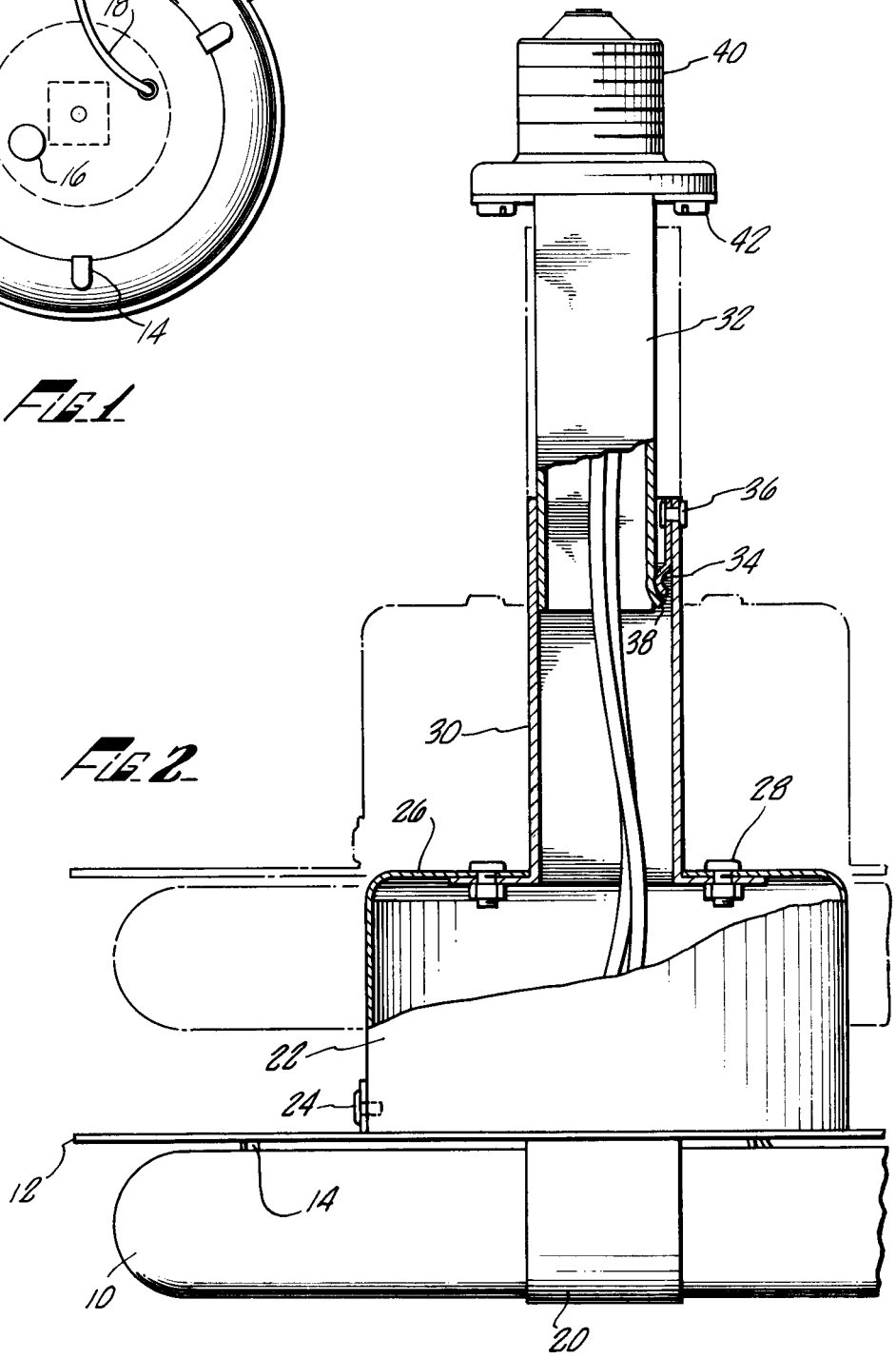
FIG. 2 is a side view of the present invention with portions of the body thereof broken away for clarity.

To provide resistance to the relative axial movement between shafts 30 and 32, a spring 34 is disposed within shaft 30, between the walls of shaft 30 and shaft 32. The spring 34 is in compression between the two shafts to create the resistance to axial movement. The spring 34 is held in place by a fastener 36, as can be seen in FIG. 2.

The spring 34 provides another function in that it cooperates with a stop 38 formed in one wall of the shaft 32 to limit axial movement between the shafts 30 and 32. The shafts 30 and 32 are shown in maximum extension with the stop 38 encountering the spring 34 in FIG. 2. FIG. 2 also shows, in phantom the extensible member in its contracted state.

A plug 40 is employed with the present fixture. This plug is capable of mating with a standardized light socket which is normally employed with incandescent bulbs. The plug 40 is secured to the opposite end of the extensible member from the transformer box 22 at one end of shaft 32. Conventional fasteners 42 may be employed.

The employment of the present florescent light fixture of the present invention in mountings for incandescent bulbs is relatively simple. The incandescent bulb is removed from a ceiling down-light leaving the fixture itself. The extensible member is extended to ensure that the plug 40 will reach the socket of the incandescent bulb mounting. The entire florescent light fixture is then threaded into the socket for electrical contact. The configuration of the shafts 30 and 32 allows transmission of the torque from the backing plate 12 and transformer box 22 to the plug 40. Once the plug 40 is positioned, the backing plate 12 and transformer 22 is simply forced upwardly until the backing plate 12 is flush with the ceiling. This is made possible by the extensible member extending between the plug 40 and the transformer box 22. Once the backing plate 12 is in position against the ceiling, the florescent tube 10 may be positioned and a diffuser also mounted on the backing plate 12. Naturally, the tube and defuser may be preassembled with the lamp prior to installation. For removal, the backing plate 12 is simply lowered and the entire fixture is rotated out of the socket.

Thus, an easily installed florescent light fixture is disclosed by the present invention which does not require substantial modification to an existing incandescent bulb down-light fixture. Thus, modification of a lighting system for florescent lights may be accomplished for savings in money and electrical power and for reduction in generated heat.

While embodiments and applications of this invention have been shown and described, it would be apparent to those skilled in the art that many more modifications are possible without departing from the inventive concepts herein described. The invention, therefore, is not to be restricted except by the spirit of the appended claims.

What is claimed is:

1. A florescent light fixture for installation in a mounting for incandescent bulbs, comprising a plug of capable of mating with a standard light socket for incandescent bulbs;

a transformer box;

a backing plate including a coupling for a florescent light, said backing plate being mounted to said transformer box; and an extensible member including a first shaft and a second shaft, one of said shafts extending into the other of said shafts and being resistively extensible in an axial direction with respect thereto, said plug being mounted at a first end of said extensible member to one end of first shaft and said transformer box being mounted at a second end of said extensible member to one end of said second shaft, said first shaft being rigidly constrained from rotation relative to said second shaft.

2. The fixture of claim 1 wherein said backing plate includes brackets adapted to receive a toroidal florescent bulb.

3. The fixture of claim 1 wherein said first and second shafts are tubes of square cross-section and said extensible member includes a spring positioned between said first and second shafts to resist axial movement therebetween.

4. The fixture of claim 3 wherein one of said shafts includes a stop extending therefrom and said spring is positioned on the other of said shafts to interfere with said stop to limit extension of said extensible member.

* * * * *